US006260554B1

(12) United States Patent
Rowland et al.

(10) Patent No.: US 6,260,554 B1
(45) Date of Patent: Jul. 17, 2001

(54) PIPE

(75) Inventors: Richard Rowland, Franklin; Corey A. Burns, Smyrna; Danny R. Gossett, Bon Aqua; Ronald R. Carruthers, Gallatin, all of TN (US)

(73) Assignee: Music City Marketing, Inc., Nashville, TN (US)

( * ) Notice: Subject to any disclaimer, the term of this patent is extended or adjusted under 35 U.S.C. 154(b) by 0 days.

(21) Appl. No.: 08/906,240

(22) Filed: Aug. 4, 1997

Related U.S. Application Data

(63) Continuation of application No. 08/460,041, filed on Jun. 2, 1995, now abandoned.

(51) Int. Cl.[7] ..... A24F 1/26

(52) U.S. Cl. ..... 131/181; 131/173; 131/174; 131/330

(58) Field of Search ..... 131/173, 174, 131/330, 179, 181, 180, 182, 183, 202

(56) References Cited

U.S. PATENT DOCUMENTS

| | | | | |
|---|---|---|---|---|
| 34,308 | | 2/1862 | Leslie . | |
| 271,011 | | 1/1883 | Wilson . | |
| 498,695 | | 5/1893 | Powell . | |
| 842,065 | | 1/1907 | Behrman . | |
| 1,039,892 | | 10/1912 | Buckow . | |
| 1,297,831 | | 3/1919 | Gilbert . | |
| 1,469,277 | * | 10/1923 | Sitter | 131/179 |
| 2,911,984 | * | 11/1959 | Gerard et al. | 131/183 |
| 3,112,756 | | 12/1963 | Schmutte . | |
| 3,451,533 | | 6/1969 | Butler . | |
| 4,214,658 | * | 7/1980 | Crow | 206/244 |
| 4,294,267 | | 10/1981 | Glymph . | |
| 4,589,427 | * | 5/1986 | Baynes | 131/181 |
| 4,612,943 | | 9/1986 | Meinkowsky . | |
| 4,850,481 | | 7/1989 | Chern . | |

FOREIGN PATENT DOCUMENTS

| | | | | |
|---|---|---|---|---|
| 340656 | | 10/1959 | (CH) . | |
| 627736 | | 10/1927 | (FR) . | |
| 418872 | | 11/1934 | (FR) . | |
| 2473277 | * | 7/1981 | (FR) | 131/202 |
| 390732 | | 4/1933 | (GB) . | |

OTHER PUBLICATIONS

River City Manufacturing Brochure "The System", about 1984.
Photographs of Think Wood Products, about 1989.
K.L. Manufacturing Brochure, about 1989.
C and C Enterprises Brochure "New Stuff", about 1991.
J & L (aka Wooden Novelties) Photographs of Products, about 1993.
"Pipes" Brochure by Primitive Creations, about 1989.
Page from Chills Catalog, 1994.
Photographs of Swan Design Products, about 1994.
Photograps of Tip Products, about 1994.
The Dugout Smoking System, Oct., 1994.

* cited by examiner

*Primary Examiner*—John G. Weiss
*Assistant Examiner*—Charles W. Anderson
(74) *Attorney, Agent, or Firm*—Laff, Whitesel, Conte & Saret, Ltd.

(57) ABSTRACT

A self-extinguishing pipe is described for use with tobacco or other smoking material. The pipe is made in two parts, a body and an endpiece, and holds a filter internally. The endpiece includes a reservoir for the tobacco or other smoking material at one end which has an adjustable base for changing the depth of the reservoir. The two-part construction and adjustable base facilitate cleaning of the pipe, replacement of the filter, and removal of ash without needing additional tools. The depth of the reservoir is adjusted by rotating an inner component of the endpiece in relation to a surrounding cowl. Various bores through the body of the pipe and the components of the endpiece communicate with each other so as to form an air passage from the smoking material to the mouth end of the pipe, thereby allowing smoke to be drawn into the user's mouth.

22 Claims, 4 Drawing Sheets

22
24
26
27
28
29
30
32
37
41
42
43
49
50
51
52
53
54
55
56
57
59
61
63
65
67
69
71
73
74
75
77
79
81
82
83
85
34
100

PIPE

This application is a continuation of U.S. patent application Ser. No. 08/460,041, filed Jun. 2, 1995, now abandoned.

FIELD

This invention relates to an apparatus used in smoking and, more particularly, to an improved, self-extinguishing pipe.

BACKGROUND

It is known to make smoking systems which use pipes to hold the tobacco for smoking instead of rolling a cigarette or buying ready-made cigarettes. It is also known to make the pipe so that it extinguishes itself after each puff. The SmokeLess Cigarette used in the Dugout Smoking System is an example of such a pipe and its related smoking system. Another example of a pipe for use with smoking material and its related system are described in Crow U.S. Pat. No. 4,214,658.

Such self-extinguishing pipes, however, have various drawbacks and shortcomings which ultimately reduce the user's comfort or enjoyment. For example, such extinguishing pipes generally accommodate only short, less effective filters, which at times results in a raw, bitter or otherwise harsh taste when smoke is inhaled.

Another drawback is that self-extinguishing pipes generally have filters located at the portions of the pipe inserted into the user's mouth. As such, the filter frequently comes in contact with the user's mouth or tongue, which causes discomfort to the user, especially when the filter is made of a gauzy material. When such a filter is used, it may become saturated with saliva or other foreign matter at the end closest to the user's mouth, further diminishing enjoyment of the smoking experience.

As still another disadvantage to such pipes, the filters are difficult to install in the pipes. The filters, generally formed of a resiliently compressible material, must be compressed by the user and stuffed through the mouthpiece of the pipe into position. This operation is time-consuming and may even require tweezers to assist in insertion of the filter, making the filters inconvenient to use.

An additional disadvantage is that if the filter is not carefully inserted, it may become cut, damaged, or otherwise lose its integrity from abrading against the mouthpiece of the pipe. The effectiveness of such filters, when damaged, is reduced.

Further drawbacks of current self-extinguishing pipes relate to the difficulty and discomfort in removing filters from the pipes. To remove a used filter, the user must resort to reaming out the filter by inserting a pipe cleaner through the pipe and pushing the filter out. The user generally must also grasp the filter at the end which was in contact with the user's mouth and has been soiled during the smoking process. The user is thus confronted with an unpleasant and inconvenient operation whenever a used filter needs to be removed from a pipe of the current art. Tar from the filter is sometimes inadvertently deposited on the mouthpiece because the filter passes through the mouthpiece during its removal. This, again, results in inconvenience or unpleasantness to the user.

Various additional disadvantages of current pipes relate to the structure of the self-extinguishing pipe apart from the filters used therein. Self-extinguishing pipes are often a single piece. Such a single-piece design makes ashes and any spent tobacco difficult to remove after use. The ashes and other spent material must be reamed out with a pipe cleaner, which, again, is both a time-consuming and messy process.

Current self-extinguishing pipes are disadvantageously constructed of a heat-conducting material, generally a metal. Although such a material resists melting, it makes the pipe far heavier than a traditional cigarette. Thus, users accustomed to holding cigarettes in the mouth or fingers find the heavier pipes clumsy to manipulate and thus distracting enough to interfere with enjoyment of smoking.

In addition, heat from the smoking material is often conducted down the length of the pipe to where the user is holding the pipe, or even as far as the user's mouth. Such heat potentially results, again, in a sharp diminution in smoking pleasure.

Thus, there is a need for a self-extinguishing pipe which is easily cleaned, safe, and comfortable. There is also a need for the pipe to be convenient to operate, namely by having the ashes and filter easily removable.

SUMMARY

Accordingly, an object of this invention is to provide an improved self-extinguishing pipe for use with smoking materials, which pipe can be simple and convenient to operate.

Another object is to provide a pipe constructed in such a manner as to allow it to be easily cleaned, safe, and comfortable for the user.

According to the present invention, the foregoing and other objects and advantages are obtained by a smoking system which includes a pipe separable into a body and an endpiece removably secured to one of the ends of the body. The endpiece has portions which define the reservoir for smoking materials. Components of the endpiece and the body can be manipulated to vary the volume of the reservoir so that it can alternately be filled with smoking materials or emptied of ashes and spent smoking material. According to another aspect of the invention, a chamber is located within the pipe and a filter is removably received within the chamber. One end of the filter abuts an interior surface of the chamber to hold the filter away from the mouth of the user. The other end of the filter protrudes from the chamber through an opening in the body, which enables the filter to be manually grasped for removal from the chamber.

In accordance with still another aspect of the invention, the reservoir includes a base which is longitudinally displaceable toward or away from the edge of the reservoir so as to vary the reservoir depth. The base of the reservoir is connected to an internal component of the endpiece, and the internal component is surrounded by a cowl. The longitudinal displacement of the internal component in relation to the cowl causes the base of the reservoir to be longitudinally displaced.

The above mentioned and other features of this invention will be best understood by reference to the following description taken in conjunction with the drawings, in which.

DESCRIPTION

Figure 1:
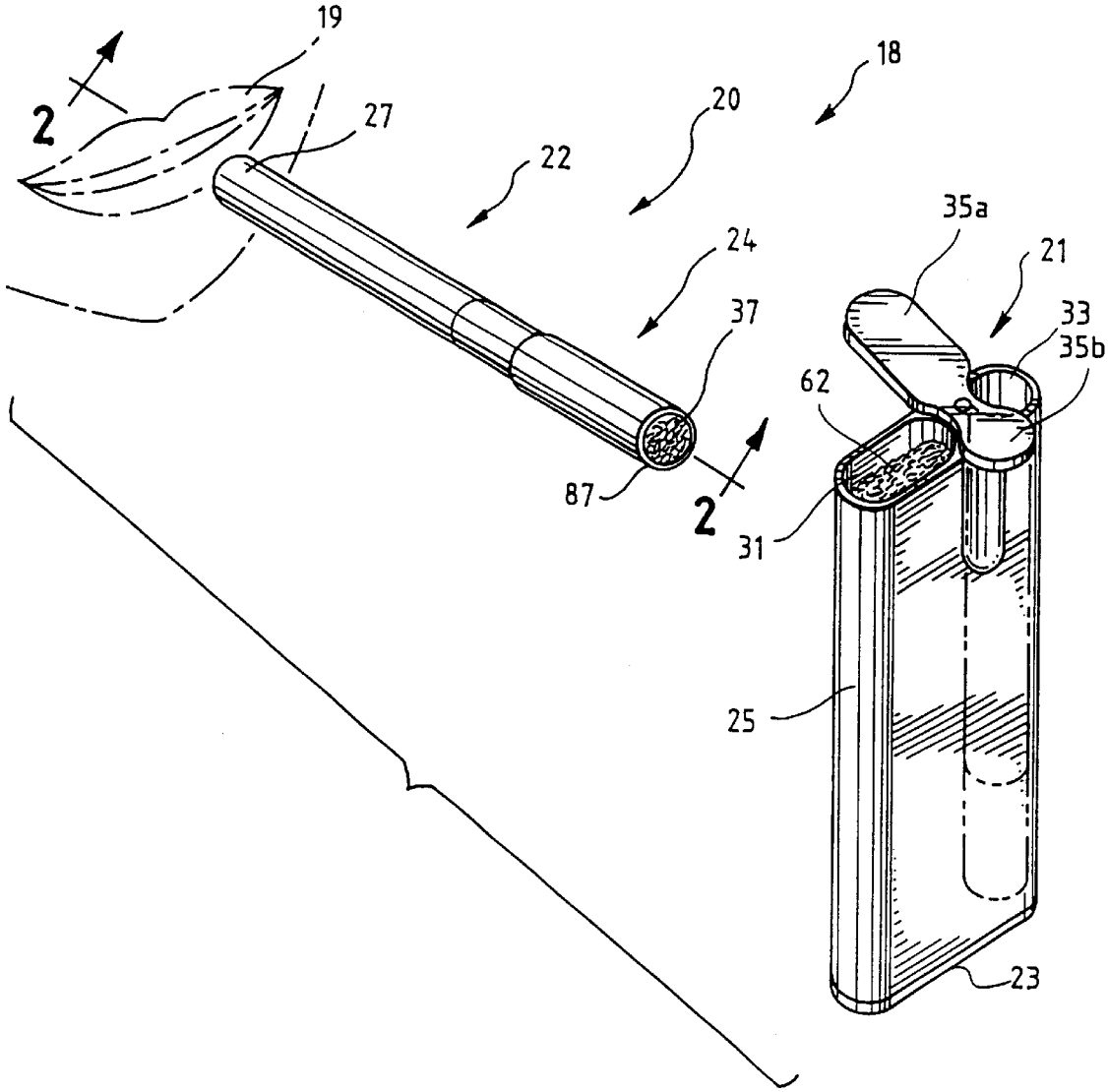
FIG. 1 is a perspective view of a smoking system according to the invention.

A smoking system 18 according to the invention is shown in FIG. 1 and includes a container 21 and a pipe 20 which can be inserted into or stored in the container 21. The pipe 20, in general terms, comprises two components: an elongated, generally cylindrical body 22 and an endpiece 24 attached to one of the ends of the body 22. The endpiece 24 includes portions which define a reservoir or bowl 37 for smoking material 62.

The container 21 in this embodiment is sized to be easily transported by the user, such as in a pocket or purse, and includes a base 23 and generally elongated sidewalls 25. Container 21 includes a compartment 31 for storing the smoking material 62, such as tobacco, and a compartment 33 sized to removably receive the pipe 20 therein. The compartments 31, 33 are accessible from the top of the container 21 and are covered by covering portions 35*a* & 35*b*, respectively.

Figure 2:
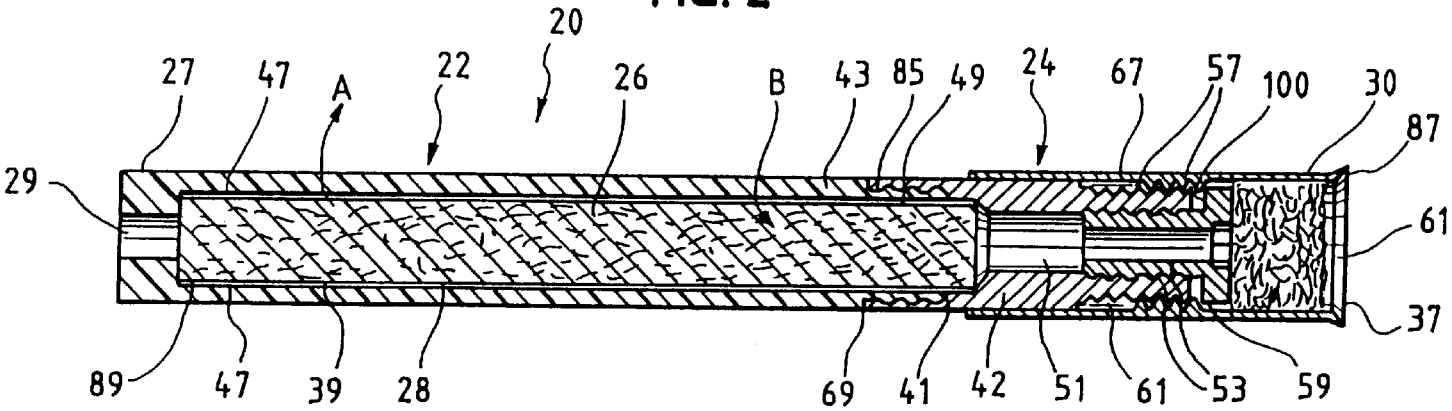
FIG. 2 is a longitudinal cross-section of the pipe of FIG. 1 taken along line 2—2.

To load the pipe 20 with the smoking material 62, the reservoir 37 of the pipe may be plunged into the compartment 31 containing a supply of the smoking material 62. When the user applies downward pressure on the pipe 20 and a clock-wise twisting motion, the smoking material 62 is packed into the reservoir 37 as shown in FIGS. 1 and 2. The pipe 20 can then be smoked by inserting mouth end 27 of the body 22 into user's mouth 19 and drawing air through passages in the pipe 20 as described subsequently.

Figure 3:
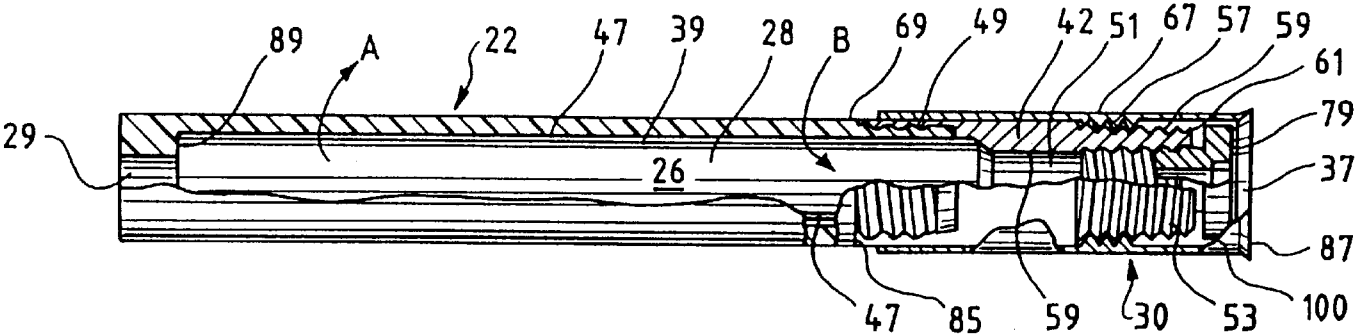
FIG. 3 is a cut-away side view of the pipe of FIGS. 1 and 2.
Figures 4, 5, 6, 7:
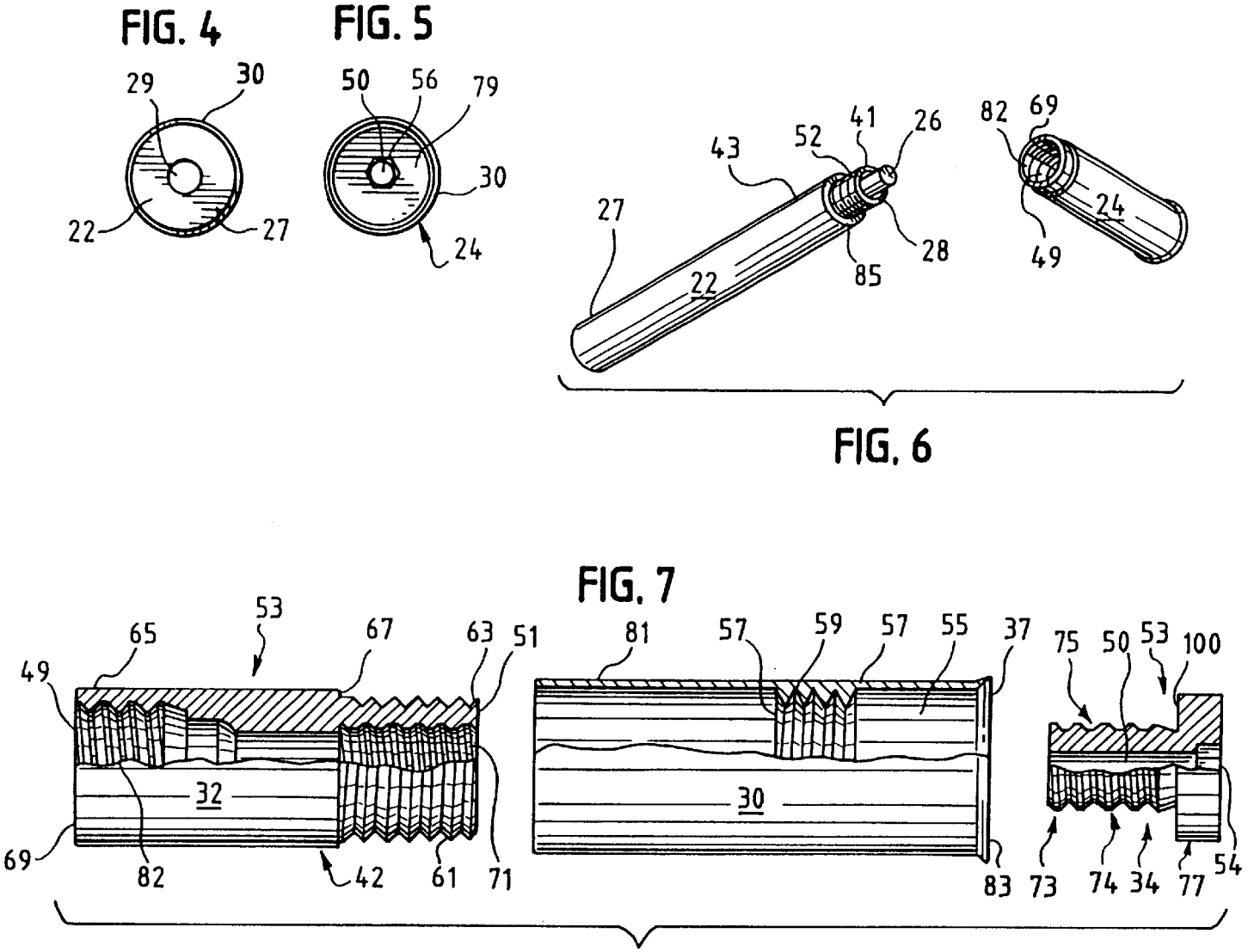
FIG. 4 is an end view of the pipe of FIGS. 1–3 taken from the mouthpiece end.
FIG. 5 is an end view of the pipe of FIGS. 1–4 taken from the reservoir end.
FIG. 6 is a perspective view showing the pipe of FIGS. 1–5 disassembled.
FIG. 7 is an enlarged, exploded cut-away side view of the smoking material reservoir of the pipe of FIGS. 1–6.

Referring to FIGS. 2–6, the body 22 has a passage 39 which extends longitudinally through the body 22 and communicates with an opening 29 located at the mouth end 27 of the body 22. The other end of the passage 39 communicates with a second opening 41 at opposite end 43 of the body 22 (FIG. 6). The passage 39 thus permits air to circulate between the opposite ends 27, 43 of the body 22.

The passage 39 includes an interior wall 47 (FIGS. 2 and 3) which defines a chamber 28 within the body 22. The chamber 28, in this particular embodiment is also a segment of the passage 39, but alternate locations of the chamber 28 are suitable so long as the chamber 28 communicates with both of the ends 27, 43 of the body 22. The chamber 28 extends through the body 22 a sufficient distance to receive substantially a filter 26.

The chamber 28 and the openi ng 41 connecte d to the chamber 28 have sufficient cross-sectional area so that the filter 26 can be removably inserted into the chamber 28 through the opening 41 as best seen in FIG. 6. The chamber 28 includes an interior, transverse surface 89 located between the chamber 28 and the opening 29 at the end 27 of the body 22. The transverse surface 89 extends sufficiently into the passage 39 to cause the filter 26 to remain longitudinally spaced from the opening 29. In this way, the filter 26 is kept from contact with the user's mouth 19 at the mouth end 27.

Referring to FIG. 6, the endpiece 24 and the body 22 are connected to each other in such a manner that they can be manually separated. When the endpiece 24 and the body 22 are separated, an end of the filter 26 protrudes from the chamber 28 through the opening 41 allowing the user easily to grasp the filter 26 by the protruding end. The endpiece 24 includes a cavity 49 which is sized to accommodate the protruding end of the filter 26 when the endpiece 24 is attached to the body 22.

Figure 8:
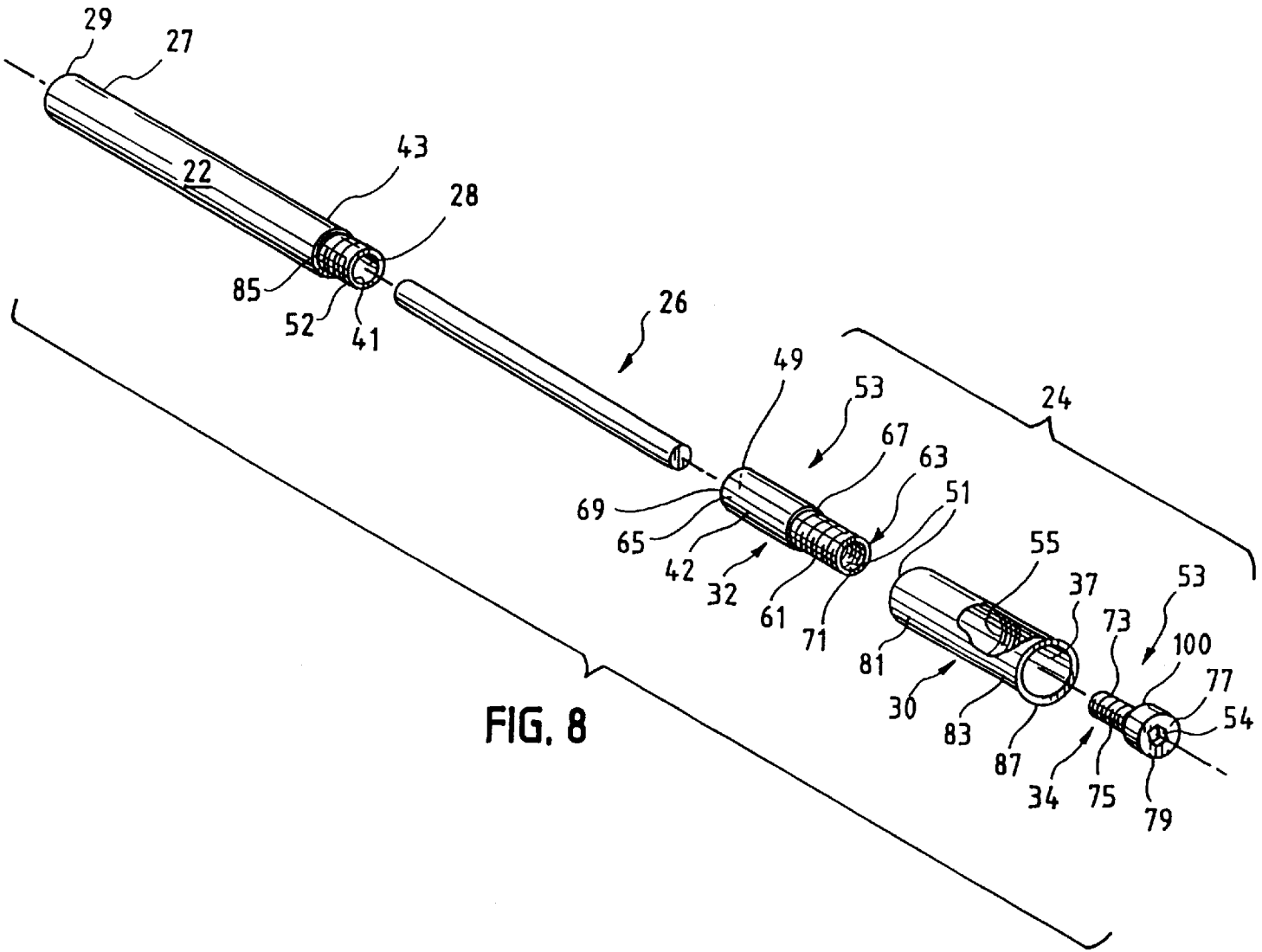
FIG. 8 is an exploded perspective view of the pipe of FIGS. 1–7.

As shown in FIGS. 2, 3, and 8, the ca vity 49 in the endpiece 24 communicates with a passage 51 which extends from the cavity 49 longitudinally through the endpiece 24 to communicate with the reservoir 37. As best shown in FIG. 8, the endpiece 24, the filter 26, and the body 22 share a common longitudinal axis. In this way, an air passage extends longitudinally through the pipe 20 from the reservoir 37 through the filter 26 and to the opening 29 at the mouth end 27 of the body 22. In use, smoke from the ignited smoking material 62 may be drawn through the resulting air passage and out the opening 29 and into the user's mouth 19.

Further features of the endpiece 24 will now be described with particular reference to FIGS. 2, 3, 5, 7 and 8. The endpiece 24 includes a cowl or outer sheath 30 and an inner component 53 received within the cowl 30. The inner component 53 is formed from two sub-components, a coupler 32 and a plunger 34, although the internal component 53 may also be a single integral piece. The inner component 53 is mounted within the cowl 30 so as to be displaceable in relation to the cowl 30 in the longitudinal direction.

By virtue of this longitudinally displaceable mounting of the inner component 53, portions of the inner component 53 and the cowl 30 cooperate with portions of the body 22 to create means for varying the volume of the reservoir 37 as described below. The cowl 30 includes an inner surface which forms side 55 of the reservoir 37 at end 83 of the cowl 30. The end 83 includes a beveled edge 87 to facilitate loading the smoking material 62 within the side 55 of the reservoir 37. The side 55 extends from the end 83 of the reservoir 37 to a threaded segment 59 inside the cowl 30. End 81 is located opposite the end 83 and includes an inner wall extending within the cowl 30 to the threaded segment 59.

As best shown in FIG. 7, within the cowl 30 is a raised portion 57 in which threads have been machined. The threads extend longitudinally along the inner surface of the cowl 30, thereby creating a threaded segment 59. The coupler 32 is thereby longitudinally received within the cowl 30. The coupler 32 has external coupler threads 61 corresponding to and engaged in the threaded segment 59 of the cowl 30. The coupler threads 61 extend longitudinally from end 63 to a seat or undercut 67 of the coupler 32.

A medial portion 42 of the coupler 32 is connected to the end 63. The medial portion 42 has a larger cross-sectional dimension than the end 63 and thereby creates the seat or undercut 67 at the boundary between the end 63 and the medial portion 42.

End 65 of the coupler 32 extends from the medial portion 42 and is located opposite the end 63 of the coupler 32. The end 65 has internal coupler threads 82 extending from edge 69 toward the medial portion 42.

The passage 51 which extends longitudinally through the coupler 32 includes internal aperture threads 71 extending longitudinally through the end 63. The plunger 34 has a head 77 and a stem 75 extending from the head 77. External threads 73 extend along the stem 75 of the plunger 34 and correspond to the internal aperture threads 71 in the coupler 32. The head 77 has an outer surface 79, an inner surface 100 opposite the outer surface 79, and a cross-sectional dimension sufficiently small to allow the head 77 to be longitudinally received within the cowl 30.

A passage 50 extends from the outer surface 79 of the head 77 longitudinally through the plunger 34 to the end of the stem 75, creating an air passage through the plunger 34. The passage 50 includes a bored segment 54 extending inwardly from the outer surface 79 and having a hexagonal cross-section. The hexagonal cross-section allows the plunger 34 to be tightly threadably secured by means of an allen wrench or other tool having a corresponding hexagonal cross-section.

The assembled endpiece 24 is formed by inserting the coupler end 63 through the end 81 of the cowl 30 and engaging the threads 61 in the threaded segment 59. The plunger 34 is received through the cowl 30 from the end 83 opposite the end 81. The threads 73 on the stem 75 of the plunger 34 engage the internal aperture threads 71 of the coupler 32 to form the inner component 53. The end 63 is sufficiently engaged through the threaded segment 59 so that the plunger 34 is fully received by the internal aperture threads 71.

When the endpiece 24 is thus assembled, the outer surface 79 of the plunger 34 serves as the base of the reservoir 37. When the inner component 53 is rotated to advance the external coupler threads 61 in relation to the threaded segment 59, the outer surface 79 moves toward the edge 87 of the reservoir 37. In this way, the effective volume of the reservoir 37 is varied as the depth of the reservoir changes as a result of advancing or retracting the outer surface 79.

The advance of the inner component 53 toward the reservoir edge 87 is limited, as shown in FIG. 3, when the seat 67 of the coupler 32 abuts the raised portion 57 of the threaded segment 59 of the cowl 30. The position of the threaded segment 59 and the length of the coupler end 63 are such that the outer surface 79 of the plunger 34 is substantially co-extensive with the edge 87 of the reservoir when the seat 67 abuts the raised portion 57. In this way, when the inner component 53 has been fully advanced toward the edge 87, the base of the reservoir 37 is substantially even with the edge 87, thereby making the effective volume of the reservoir almost zero.

The longitudinal displacement of the inner component 53 away from the edge 87 of the reservoir is limited, as shown in FIG. 2, by contact between the inner surface 100 of the head 77 and the raised portion 57. When the inner component 53 has been retracted to this limit position, the base of the reservoir 37 is farthest from the edge 87, thereby giving the reservoir 37 its greatest depth.

The body 22 has external body threads 52 extending at the end 43 of the body 22 from the opening 41 and terminating in a flange 85. The external threads 52 cooperate with the internal coupler threads 82 in the coupler end 65. The end 43 of the body 22 thus is removably attachable to the endpiece 24. When the end 43 of the body 22 has been fully received in the coupler end 65, the flange 85 around the opening 41 abuts the edge 69 of the coupler 32, thereby seating the body 22 against the endpiece 24.

The threads associated with the cowl 30, the coupler 32, the plunger 34, and the body 22, have been selected to have either left-hand or right-hand orientation. The various thread orientations cooperate to bring about certain desirable features in the operation and use of the pipe 20, as will now be described. The external coupler threads 61 of the coupler 32 and the threaded segment 59 of the cowl 30 have a left-hand orientation. The following threads have a right-hand orientation: the body threads 52, the internal coupler threads 82, the internal aperture threads 71 located at the end 63 of the coupler 32, and the corresponding external threads 73 disposed on the stem 75 of the plunger 34.

According to the above described arrangement of threads, the inner component 53 is displaced longitudinally from its position shown in FIG. 2 toward the edge 87 of the reservoir 37 by rotating the body 22 relative to the cowl 30 in a counter-clockwise direction indicated by the arrow A. This operation shortens the reservoir depth and can thus be used to push spent tobacco or ashes out of the reservoir 37. The volume of the reservoir 37 decreases until it reaches its minimum volume as shown in FIG. 3.

If the body 22 continues to be rotated relative to the endpiece 24 in the counter-clockwise direction indicated by the arrow A, further longitudinal advancement of the plunger 34 is prevented by contact between the seat 67 and the raised portion 57. Instead, continued counter-clockwise rotation of the body 22 relative to the endpiece 24 causes the body 22 to disengage from the internal coupler threads 82 of the endpiece 24. With continued counter-clockwise rotation relative to the endpiece 24, the body 22 separates from the endpiece 24 as shown in FIG. 6. Separation of the body 22 and the endpiece 24 allows the user to insert or replace the filter 26 into the chamber 28.

When the user desires to reassemble the separated components 22 and 24, the external body threads 52 are engaged in the cooperating internal threads 82, and the body 22 is rotated relative to the endpiece 24 in a clockwise direction indicated by the arrow B. (FIG. 3) Continued clockwise rotation of the body 22 relative to the endpiece 24 in the direction indicated by the arrow B will cause the flange 85 of the body 22 to contact the edge 69 of the endpiece 24, thereby securely attaching the body 22 to the endpiece 24 as shown in FIG. 3.

After the flange 85 has seated against the edge 69, continued clockwise rotation of the body 22 relative to the cowl 30 will cause the inner component 53 to rotate in relation to the cowl 30. Because the external coupler threads 61 are left-handed, the clockwise rotation will longitudinally displace the inner component away from the edge 87 of the reservoir. Continued clockwise rotation relative to the cowl 30 in the direction of arrow B eventually extends the reservoir 37 to its full depth as shown in FIG. 2. When the reservoir 37 is at its full depth, the inner surface 100 of the head 77 contacts the raised portions 57 to limit further retraction of the base of the reservoir. The pipe 20 can be plunged into the tobacco compartment 31 (FIG. 1), as discussed previously, to load the fully extended reservoir 37 with the smoking material 62.

If the user continues to rotate the body 22 relative to the endpiece 24 in the clockwise direction of the arrow B after the reservoir has been extended to its full depth, the pipe 20 will remain intact and ready for use. In fact, the arrangement of threads detailed above prevents accidental disassembly of the endpiece 24 into its component parts. In particular, the plunger 34 seated against the raised portion 57 will not be disengaged from the coupler 32 by rotation in the clockwise direction because the cooperating threads 71, 73 are right-handed.

The various threaded engagement and disengagement of the body 22, the inner component 53, and the cowl 30 described above combine to make operation of the pipe 20 by the user simple and convenient. From beginning to end, a user may employ the smoking system 18 as follows: The pipe 20 would be removed from the compartment 33 (FIG. 1). Assuming the inner component 53 is positioned as shown in FIG. 3, the user would rotate the body 22 relative to the endpiece 24 in a counter-clockwise direction to separate the body 22 and the endpiece 24 if the user wanted to insert or replace the filter 26 into the pipe 20. To reclose the pipe, the user would reattach the body 22 and the endpiece 24 by rotating the body 22 relative to the endpiece 24 in the clockwise direction indicated by the arrow B, thereby engaging the cooperating threads 52, 82. Once the flange 85 of the body 22 is seated against the edge 69, the user simply continues to rotate the body 22 relative to the cowl 30 in the clockwise direction of the arrow B, thereby retracting the inner component 53 from the reservoir edge 87 until the reservoir 37 has been extended to its full depth shown in FIG. 2.

The pipe 20 is plunged into the compartment 31, where the beveled edge 87 cuts into the smoking material 62 stored in the compartment 31. Downward pressure, combined with a clockwise twisting action, accomplishes the loading of the smoking material 62 into the reservoir 37 without causing the pipe 20 to become disassembled during the course of loading it with tobacco.

After the pipe is lit up and the tobacco consumed, the user simply rotates the body 22 relative to the cowl 30 in the counter-clockwise direction indicated by the arrow A, thereby advancing the plunger 34 toward the reservoir edge 87 to expel spent smoking material and ashes. After the expulsion of spent material from the reservoir, the pipe 20 again is in the position shown in FIG. 3.

At this point, the user has two options which are simple to execute because of the features of this invention. If the user wishes to replace the filter 26, he merely continues the counter-clockwise rotation relative to the cowl 30 used to expel the ashes in order now to separate the body 22 and the endpiece 24 and thereby expose the spent filter 26 as shown in FIG. 6. If, instead, the user wishes to have another smoke without changing the filter 26, he rotates the body 22 relative to the cowl 30 in the clockwise direction of the arrow B to re-extend the reservoir 37 to its full depth so that the reservoir is ready to receive fresh tobacco.

Although pipes incorporating the principals of this invention can be built in various sizes, the dimensions of a preferred embodiment are about 3.25" in length when the pipe is extended to its full depth, 0.34" in diameter at the mouth end, and 0.41" in diameter at the tobacco-receiving end. When the body and endpiece are separated, the body 22 has a length of 2.25" and the endpiece, a length of 0.85", not including any protrusion from the endpiece by the coupler 32.

The interior chamber 28 of the body has a length of about 2.05". Such a length allows a standard, charcoal pipe filter, such as those made by Dr. Grabow, Sparta Industries, Sparta, N.C., to be received in the chamber 28 with an end slightly protruding to facilitate the interchange of filters.

The body 22 is preferably made of a lightweight, heat-resistant, and thermally insulating material, such as Lexan plastic. The endpiece 24 is preferably formed of a machinable metal, such as aluminum. Use of aluminum is also advantageous because it is relatively lightweight and has relatively low heat conductivity. The decreased weight from using Lexan plastic and aluminum results in the pipe 20 having a shape and weight more nearly like a conventional cigarette. In this way, the user can hold the pipe 20 in his or her fingers or mouth in the same manner as a conventional cigarette, which increases its attractiveness to those who are accustomed to smoking in social situations.

In addition to the advantages apparent from the foregoing description, the pipe 20 according to the present invention has numerous other advantageous features. Construction of the body 22 from heat-resistant material results in a pipe 20 which not only does not melt, but also does not conduct undesirable heat through the body 22 to where the user may be holding the pipe or inserting it into his or her mouth.

The pipe according to the present invention also has the advantage of holding the filter within the pipe so that it does not touch the user's tongue, making for a cleaner, more pleasant smoke. The pipe 20 also can accommodate a longer, more effective filter within the chamber 28.

As to another advantage, the multi-piece form allows ashes and spent smoking material to be expelled from the pipe without requiring additional tools. This makes the pipe much less messy to deal with.

Alternative embodiments of the present invention may replace the threaded segment 59 of the cowl 30 and the cooperating threads 61 of the coupler 32 with another means, such as a friction fitting, for longitudinally displacing the inner component 53 in relation to the cowl 30. For example, the threaded segment 59 may instead comprise a sleeve formed of rubber or polymeric material and the cooperating threads 61 may be replaced by a smooth surface which frictionally engages the sleeve.

Similarly, the cooperating threads 52, 82 between the body 22 and the coupler 32 can be replaced with alternative means for making the body 22 removably securable to the endpiece 24, such as by replacing the threads 52 with a configuration, such as a flange to engage the end 65 of the coupler 32 in a snugfit manner.

As still another alternative, although the body 22 includes integral portions to be inserted in the user's mouth at the mouthend 27, separate mouthpiece portions could be provided, which portions are removable from the body 22.

While the present invention has been described with reference to a preferred embodiment thereof, illustrated in the accompanying drawings, various changes and modifications can be made by those skilled in the art without departing from the spirit and scope of the present invention; therefore, the appended claims are to be construed to cover equivalent structures.

What is claimed is:

1. A pipe for use with smoking materials, the pipe comprising:

an elongated body having a longitudinal axis and opposite ends, the ends having openings therein, the body having an interior wall defining a passage extending through the body and communicating with the openings at the ends;

an endpiece removably secured to one of the ends of the body, the endpiece having portions defining a reservoir for smoking materials, the reservoir in communication with the passage in the body when the endpiece is secured to the body;

the reservoir comprising a base and a side extending from the base and terminating in an edge and having a depth measurable from the edge of the reservoir; and means for varying the volume of the reservoir between a maximum volume and a minimum volume by rotating the body relative to the endpiece about the longitudinal axis, whereby the means for varving the volume advances the base toward the edge to decrease the depth of the reservoir when the body is rotated relative to the endpiece in a first direction and retracts the base away from the edge to increase the depth of the reservoir when the body is rotated relative to the endpiece in a second direction.

2. The pipe of claim 1 wherein the interior wall defines a chamber within the body, and wherein the pipe includes a filter removably received in the chamber.

3. The pipe of claim 2 wherein the chamber communicates with one of the openings of the body, the filter is received in the chamber through one of the openings of the body, and the filter has an end protruding from the one opening to enable the filter to be manually grasped for removal from the chamber.

4. The pipe of claim 3 wherein the endpiece includes a cavity into which the protruding end of the filter is received when the endpiece is secured to the body.

5. The pipe of claim 1 wherein the advancing and retracting means comprise an internal component and a cowl surrounding the internal component, the internal component and the cowl having a common longitudinal axis, the internal component having an outer surface comprising the base of the reservoir, and the cowl having inner surfaces comprising the side of the reservoir, and wherein the internal component is receivable within the cowl and displaceable longitudinally in relation to the inner surfaces of the cowl to advance and retract the base of the reservoir.

6. The pipe of claim 5 wherein the cowl and the internal component are operatively connected to each other by screw threads extending along the longitudinal axis, the upper surface of the plunger being displaceable longitudinally by rotating the internal component relative to the cowl about the longitudinal axis.

7. The pipe of claim 5, wherein the internal component comprises a coupler having first and second ends, with the second end having a greater cross section than the first end to form a seat between the second end and the first end;

the cowl is cylindrical and has an interior wall defining a longitudinal bore therein, the interior wall of the bore having a raised portion protruding inward from the interior wall of the bore to narrow the bore to engage the seat of the coupler while allowing passage of the first end of the coupler, the coupler being displaceably received within the cowl; and the internal component further comprises a plunger having a stem and a head, the head having a first surface comprising the base for the reservoir and a second surface having a diameter sufficiently large to engage the raised portion of the cowl, the stem of the plunger adapted to be attached to the first end of the coupler such that the longitudinal distance between the head of the plunger and the first end of the coupler is adjustable.

8. The pipe of claim 7, wherein the raised portion includes a threaded segment and the first end of the coupler has external coupler threads corresponding to and engaged in the threaded segment of the raised portion, whereby the base is longitudinally displaced by rotating the coupler and the cowl in relation to each other.

9. The pipe of claim 8, wherein the first end of the coupler has a longitudinal aperture having internal aperture threads, wherein the stem of the plunger has screw threads corresponding to the internal and wherein the external coupler threads of the coupler have a first orientation and the internal aperture threads have a second orientation opposite the first orientation so that when the coupler has been rotated to the point where the head of the plunger contacts the raised portion, further rotation of the coupler does not disengage the plunger from the coupler.

10. The pipe of claim 9, wherein the second end of the coupler includes internal coupler threads and terminates in an edge, and wherein one of the openings of the body includes external body threads corresponding to the internal coupler threads, the second end of the coupler being threadably engageable in the one opening of the body, the one opening having flange portions which abut the edge of the second end when the second end has been fully engaged in the one opening.

11. The pipe of claim 10, wherein the external coupler threads and the threaded segment are left-handed threads and the internal aperture threads and the internal coupler threads are right-handed threads. communication with the passage in the body when the endpiece is secured to the body; and means for varying the volume of the reservoir between a maximum volume and a minimum volume; and means for varying the maximum volume.

12. The pipe of claim 9, wherein the internal coupler threads are oriented opposite the first orientation of the external coupler threads, so that when the coupler has been rotated to the point where the seat of the medial portion contacts the raised portion, further rotation of the body relative to the endpiece disengages the body threads from the internal coupler threads, thereby separating the edge from the flange to separate the body from the endpiece.

13. The pipe of claim 1 wherein the body includes portions formed of material which does not conduct heat.

14. The pipe of claim 1 wherein the material is plastic.

15. The pipe of claim 1 further comprising means for separating the body from the endpiece by continued rotation of the body relative to the endpiece after the minimum volume has been reached.

16. The pipe of claim 1 further comprising means for varying the maximum volume.

17. A smoking system for use with smoking materials, the smoking system comprising a pipe and a container for the pipe:

the pipe having an elongated body having a longitudinal axis and opposite ends, the ends having openings therein, the body having an interior wall defining a passage extending through the body and communicating with the openings at the ends;

an endpiece removably secured to one of the ends of the body, the endpiece having portions defining a reservoir for smoking materials, the reservoir in communication with the passage in the body when the endpiece is secured to the body;

the reservoir comprising a base and a side extending from the base and terminating in an edge and having a depth measurable from the edge of the reservoir;

means for varying the volume of the reservoir to receive or to expel the smoking materials by rotating the body relative to the endpiece about the longitudinal axis, wherebv the means for varying the volume advances the base toward the edge to decrease the depth of the reservoir when the body is rotated relative to the endpiece in a first direction and retracts the base away from the edge to increase the depth of the reservoir when the bodv is rotated relative to the endpiece in a second direction; and the container having a first compartment for smoking materials and a second compartment sized to removably receive the pipe therein, the container having portions to cover the compartments.

18. The smoking system of claim 17, comprising a filter sized to be removably received in the passage.

19. A pipe for use with smoking materials, the pipe comprising:

an elongated body having opposite ends, the ends having openings therein, the body having an interior wall defining a passage extending through the body and communicating with the openings at the ends;

an endpiece removably secured to one of the ends of the body, the endpiece having portions defining a reservoir for smoking materials, the reservoir being in communication with the passage in the body when the endpiece is secured to the body; and means for varying the volume of the reservoir between a maximum volume and a minimum volume; and means for varying the maximum volume.

20. The pipe of claim 19 wherein the means for varying the volume of the reservoir comprises an internal component and a cowl surrounding the internal component, the internal component and the cowl having a common longitudinal axis, the internal component having an outer surface comprising the base of the reservoir, and the cowl having inner surfaces comprising the side of the reservoir, and wherein the internal component is receivable within the cowl and displaceable longitudinally in relation to the inner surfaces of the cowl to advance and retract the base of the reservoir.

21. The pipe of claim 20 wherein the internal component comprises a coupler having first and second ends, with the second end having a greater cross section than the first end to form a seat between the second end and the first end;

the cowl is cylindrical and has an interior wall defining a longitudinal bore therein, the interior wall of the bore having a raised portion protruding inward from the interior wall of the bore to narrow the bore to engage the seat of the coupler while allowing passage of the first end of the coupler, the coupler being displaceably received within the cowl; and the internal component further comprises a plunger having a stem and a head, the head having a first surface comprising the base for the reservoir and a second surface having a diameter sufficiently large to engage the raised portion of the cowl, the stem of the plunger adapted to be attached to the first end of the coupler such that the longitudinal distance between the head of the plunger and the first end of the coupler is adjustable.

22. The pipe of claim 21 wherein the first end of the coupler has a longitudinal aperture having internal aperture threads, wherein the stem of the plunger has screw threads corresponding to the internal aperture threads, the stem adapted to be threadably secured to the first end of the coupler.

* * * * *